US010337829B2

(12) United States Patent
Spielberger

(10) Patent No.: US 10,337,829 B2
(45) Date of Patent: Jul. 2, 2019

(54) BATTLEFIELD ILLUMINATION MODULE, HANDGUN WITH A BATTLEFIELD ILLUMINATION MODULE AND HOLSTER FOR A HANDGUN WITH BATTLEFIELD ILLUMINATION MODULE

(71) Applicant: Peter Spielberger, Vienna (AT)

(72) Inventor: Peter Spielberger, Vienna (AT)

( * ) Notice: Subject to any disclaimer, the term of this patent is extended or adjusted under 35 U.S.C. 154(b) by 20 days.

(21) Appl. No.: 15/507,124

(22) PCT Filed: Aug. 4, 2015

(86) PCT No.: PCT/EP2015/067890

§ 371 (c)(1),
(2) Date: Feb. 27, 2017

(87) PCT Pub. No.: WO2016/030152

PCT Pub. Date: Mar. 3, 2016

(65) Prior Publication Data

US 2017/0284769 A1 Oct. 5, 2017

(30) Foreign Application Priority Data

Aug. 28, 2014 (AT) ..... A 50596/2014

(51) Int. Cl.
*F41G 1/35* (2006.01)
*F41C 33/02* (2006.01)

(52) U.S. Cl.
CPC ..... *F41G 1/35* (2013.01); *F41C 33/029* (2013.01); *F41C 33/0254* (2013.01)

(58) Field of Classification Search
CPC ..... F41G 1/34; F41G 1/35; F41G 1/36; F41G 3/06; F41C 33/0254; F41C 33/029
See application file for complete search history.

(56) References Cited

U.S. PATENT DOCUMENTS 5,956,107 A * 9/1999 Hashimoto ..... G01D 11/28 349/62
6,892,488 B1 * 5/2005 Serravalle ..... F41A 5/02 42/113
6,913,370 B2 * 7/2005 Ping ..... F21L 4/045 362/197
7,303,306 B2 * 12/2007 Ross ..... F41C 27/00 362/103
7,441,364 B2 * 10/2008 Rogers ..... F41G 1/35 42/114

(Continued)

FOREIGN PATENT DOCUMENTS

DE 9007781 U1 4/1996
WO 2012021216 A2 2/2012

OTHER PUBLICATIONS

"Tdi Arms 5 Position Flashlight Mounting Ring—.63in-.76in", Sep. 21, 2015, opticsplanet.com (Year: 2015).*

(Continued)

*Primary Examiner* — Joshua T Semick
(74) *Attorney, Agent, or Firm* — Whitmyer IP Group LLC

(57) ABSTRACT

A battlefield illumination module having a light source for a handgun, a handgun with an appropriate battlefield illumination module and a holster for accommodating an appropriate handgun, wherein the light source includes a primary light source which is designed to be extendable from a rest position to a working position.

22 Claims, 2 Drawing Sheets

(56) References Cited

U.S. PATENT DOCUMENTS

| | | | | |
|---|---|---|---|---|
| 7,735,255 | B1 * | 6/2010 | Kincaid | F41C 33/0254 362/110 |
| 8,205,372 | B2 * | 6/2012 | Anzeloni | F41A 17/063 42/70.01 |
| 8,485,858 | B2 * | 7/2013 | Wei | F41G 1/35 446/473 |
| 8,739,447 | B2 * | 6/2014 | Merritt | F41G 11/004 362/110 |
| 9,568,276 | B2 * | 2/2017 | Jackson | F41G 1/35 |
| 2007/0277422 | A1 * | 12/2007 | Ding | F41G 1/35 42/146 |
| 2008/0060248 | A1 * | 3/2008 | Pine | F41G 1/35 42/114 |
| 2008/0209789 | A1 * | 9/2008 | Oz | F41G 1/35 42/90 |
| 2009/0097235 | A1 * | 4/2009 | Chambers | F21V 33/0052 362/110 |
| 2011/0181238 | A1 | 7/2011 | Soar | |
| 2012/0097718 | A1 | 4/2012 | Baumann et al. | |
| 2012/0124885 | A1 | 5/2012 | Caulk et al. | |
| 2013/0283661 | A1 * | 10/2013 | Lynn | F41G 1/35 42/114 |

OTHER PUBLICATIONS

"Coast Mini Tac Torch—Silver case Tactical Use Light LL7831", Mar. 14, 2013, opticsplanet.com (Year: 2013).*

Austrian Search Report Application No. A50596/2014 Completed Date: Feb. 17, 2015 1 Page.

English Translation of International Search Report Application No. PCT/EP2015/067890 Completed Date: Oct. 12, 2015; dated Oct. 16, 2015 3 Pages.

International Search Report & Written Opinion Application No. PCT/EP2015/067890 Completed Date: Oct. 12, 2015; dated Oct. 16, 2015 11 Pages.

* cited by examiner

BATTLEFIELD ILLUMINATION MODULE, HANDGUN WITH A BATTLEFIELD ILLUMINATION MODULE AND HOLSTER FOR A HANDGUN WITH BATTLEFIELD ILLUMINATION MODULE

TECHNICAL FIELD

The invention relates to a battlefield illumination module having a light source for a handgun, a handgun with an appropriate battlefield illumination module and a holster for accommodating an appropriate handgun.

BACKGROUND

Devices for battlefield illumination are well known particularly in the field of application of military and police special units. Here, as well as lasers, which are normally used for target marking, illumination means such as lamps, searchlights or the like are also used. Fixed directly to the weapon, the task of these illumination means consists of illuminating the immediate environment to an extent that the soldiers, officers or marksmen are able to recognize and assess the situation.

As an example, for this purpose, US 2012/0124885 A1 shows an illumination module which is fixed in the area of the muzzle or trigger guard of a handgun. Designated as handguns are those firearms with which the barrel including breech has a total length of less than 30 cm. When such conventional illumination modules with a lamp are used, these are usually relatively voluminous in design due to the lamp reflector. As a further consequence, this leads to the problem that the storage pocket, usually referred to as holster, does not allow the weapon including the battlefield illumination module to be accommodated without difficulty. If a holster which is adapted to suit the battlefield illumination module is used, then this in turn is unsuitable for accommodating the weapon without the battlefield illumination module, as secure storage of the weapon cannot be guaranteed due to the poor retention in the holster.

A further problem which occurs with conventional illumination modules is the question of activation. Normally, an appropriate switch, with which the lamp or searchlight, or also the previously mentioned laser for target marking, is activated, is provided on the illumination module. Such an additional switch requires additional effort for the marksman, referred to in the following as an officer, in the event of deployment or use of the weapon.

Such a system requires an exact procedure when handling the weapon so that the battlefield illumination or target marking is activated at the correct time. A procedure of this kind for individual handling operations is of course practiced as part of the training and drill of the above-mentioned officer.

However, it cannot be ensured that, in the course of a deployment, that is to say under significantly increased stress level, the decisive handling operations are carried out at the right moments and therefore battlefield illumination and target marking are activated or are activated at the right moment.

SUMMARY

One object of the present invention includes developing a battlefield illumination module for a handgun which is as compact as possible.

According to one embodiment of the present invention, the object is achieved with a battlefield illumination module and with a handgun of the kind mentioned in the introduction in that the light source comprises a primary light source which is designed to be extendable from a rest position to a working position. This enables a design of the battlefield illumination module in the rest position that is as compact as possible yet with full functionality of the light source in the appropriate working position. As a result, the difference in volume of a handgun with and without the battlefield illumination module is reduced to a minimum and enables a holster to be used for the handgun with and without the battlefield illumination module.

In an advantageous manner, it is provided that the light source has an energy supply and that the light source is only connected to the energy supply in the working position. This prevents the light source from transmitting light in its rest position. On the one hand, this enables an increased energy consumption to be avoided and, on the other, an officer, as carrier of the handgun, does not unintentionally draw attention to himself due to a light source which is switched on unknowingly.

Further, it can advantageously be provided that the light source further comprises a secondary light source and that the secondary light source is formed by at least one laser. As well as illuminating the immediate environment, this therefore also enables simplified sighting of possible targets by a mark generated by the laser.

Advantageously, it can be provided that the secondary light source is formed by a plurality of lasers of different wavelengths and a first switching element for selecting at least one laser is provided on the battlefield illumination module. For example, if there are several officers at a locally limited deployment location, such as a single room, for example, the individual marks can be differentiated from one another as a consequence of color differences.

Further, it can be provided that a symbol-imaging ancillary lens is positioned in front of at least one laser of the secondary light source. By this means, a circular ring, a crosshair or the like, for example, is formed by the laser instead of a spot, which in turn guarantees better differentiation from other marks.

An advantageous embodiment provides that different symbol-imaging ancillary lenses are positioned in front of the lasers and the symbol-imaging ancillary lenses are preferably replaceable. An appropriate symbol can therefore be chosen for marking the target depending on the selected laser. The replaceability enables a variation from the specified symbols and a wide range of different symbols for marking the target to be selected depending on the number of officers deployed.

A further advantageous embodiment provides that a second switching element for the primary light source and/or the secondary light source is provided on the battlefield illumination module. This enables the respective light source to be activated accordingly, that is to say put into a light-emitting state or deactivated, depending on the requirement.

Advantageously, it is provided that a third switching element, by means of which the primary light source can be put into a non-light-emitting state as required, is provided on the battlefield illumination module. If, for example, illumination of the immediate environment is not required, the primary light source can be deactivated in this way.

Advantageously, the third switching element is formed by a brightness sensor. If, therefore, the immediate environment is already adequately illuminated, this is detected by the brightness sensor and the primary light source is deactivated.

Advantageously, in a described battlefield illumination module, it is provided that the second switching element is formed by a sensor arrangement. As a result, it is unnecessary to operate a mechanical switch or button, as a result of which the usability is considerably simplified, particularly in stress situations.

As is known, a handgun already mentioned has a trigger, wherein it is provided that the sensor arrangement detects the immediate area of the trigger. In this way, the second switching element, which puts the light source into a light-emitting state, is only activated when, for example, the finger of an officer is detected in the immediate area of the trigger. In this way, unintentional activation of the light source is prevented.

Further, a holster can be provided for accommodating a handgun with the battlefield illumination module previously described, wherein the holster has an electrical holster contact for conducting a charging current which is connected by means of appropriate wires to an energy source which is external with respect to the battlefield illumination module, and, when the handgun is located in the holster, the energy supply of the light source of the battlefield illumination module attached to the handgun is connected to the holster contact by means of the electrical contact.

This enables the energy supply of the light source of the battlefield illumination module attached to the handgun to be recharged while the handgun is stored. This prevents an unexpected failure of the light source due to a lack of energy provision. Instead of the contact, recharging could also be carried out inductively in the familiar way, for example as used for electrical devices in wet rooms.

BRIEF DESCRIPTION OF THE DRAWINGS

The present invention is explained in more detail below with reference to FIGS. 1 to 4, which show advantageous embodiments of the invention in an exemplary, schematic and non-restricting form. In the drawing

DETAILED DESCRIPTION

Figure 1:
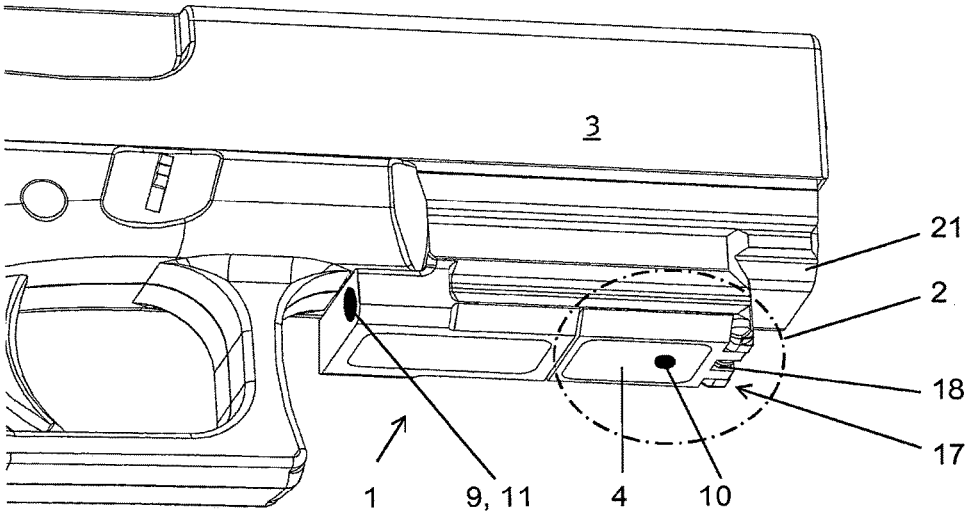
FIG. 1 shows parts of a schematically shown handgun and a battlefield illumination module according to the invention fixed thereto.

Parts of a schematically shown handgun 3 of the type used in the military sector or also by officers of the executive, for example, can be seen in FIG. 1. A battlefield illumination module 1 with a light source 2 is arranged in the area of the barrel of the handgun 3 shown.

FIG. 1 shows that the battlefield illumination module 1 is fixed to a Picatinny rail 21, wherein the fixing variant of this kind is chosen purely by way of example. Handguns 3, or firearms in general, are usually equipped with a fixing facility, designated as Picatinny rail 21, in the area below the barrel, which allows a wide range of different accessories to be fixed to the handgun 3. It is, of course, also conceivable for any other clamping or fixing system to be used for fixing the battlefield illumination module 1.

Further, it must be noted that a Picatinny rail 21 of this kind is used on a wide range of firearms. Also, with regard to further possible clamping and fixing systems, it must be pointed out that the use of the described battlefield illumination module 1 is not restricted exclusively to use on a handgun 3. However, for simplicity, in the following, reference is made solely to a handgun 3 in conjunction with the use of the battlefield illumination module 1.

Figure 2:
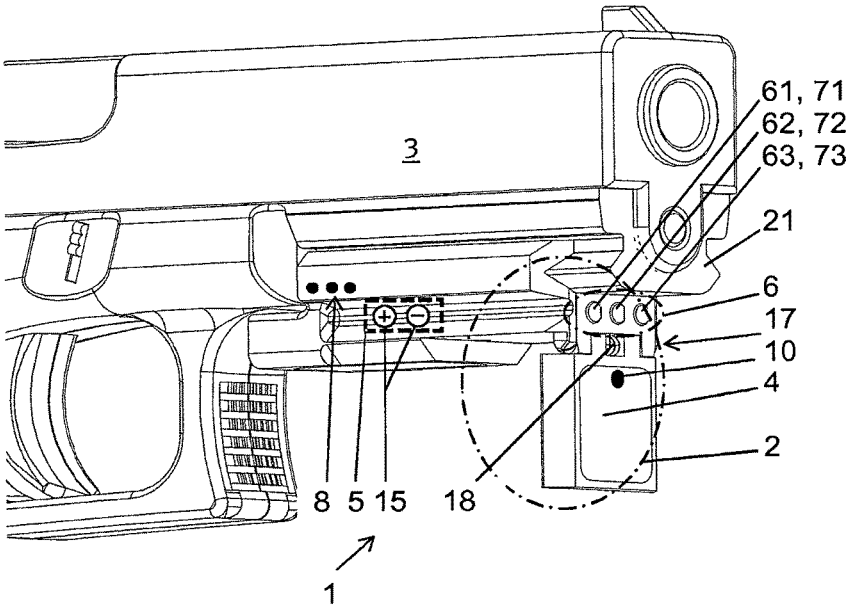
FIG. 2 shows parts of the schematically shown handgun with the battlefield illumination module fixed thereto and the primary light source in the working position.
Figure 3:
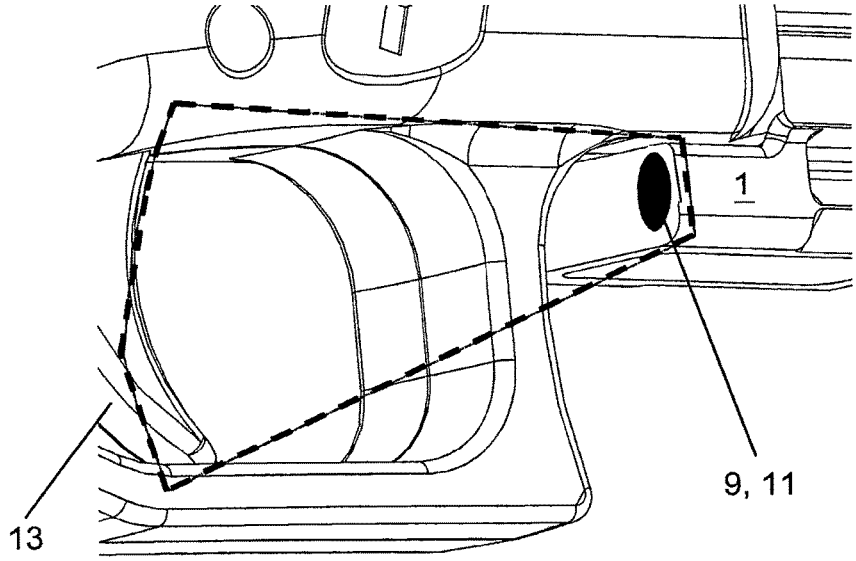
FIG. 3 shows the detection range of the sensor arrangement which advantageously forms the second switching element.

As can be seen particularly in FIG. 2, the light source 2 comprises a primary light source 4, which is designed to be extendable from a rest position shown in FIG. 1 to a working position shown in FIG. 2. The extension movement shown in FIGS. 1 to 3 is realized by way of example in the form of a swivel or hinged movement about the joint 17. Of course, the extension movement is also conceivable in the form of a horizontal or vertical displacement of the primary light source 4. Inherently, the working position as shown in FIG. 2 is characterized in that the light which is emitted by the primary light source 4 is transmitted substantially in the direction of the battlefield or away from the marksman or officer. This allows the illumination of the immediate environment of the officer who is carrying the handgun 3 or who has aimed at a target.

When handling the handgun 3, it is assumed that the handgun 3 is stored or carried in a storage pocket, usually referred to as holster 14. However, common holsters 14 provided for the type of handgun 3 only offer sufficient space for the handgun 3 itself in order to guarantee the secure retention of the handgun 3. If a conventional battlefield illumination device is provided on the handgun 3, an appropriately shaped holster 14 is also required. For this reason, there are some compatibility problems when using a handgun 3 in conjunction with possibly widely differing elements provided for battlefield illumination. Also, a holster 14, which is provided for a handgun 3 including a battlefield illumination device, does not provide adequate retention for the handgun 3 when this is not equipped with the appropriate battlefield illumination device.

The embodiment of a battlefield illumination module 1 according to the invention enables a design of the battlefield illumination module 1 in its rest position which is as compact as possible yet with full functionality of the light source 2 in the appropriate working position. As a result, the difference in volume of a handgun 3 with and without the battlefield illumination module 1 is reduced to a minimum and it is possible to use a conventional holster 14 provided for the type of handgun 3.

The transition from the rest position to the working position occurs when the handgun 3 is drawn from its holster 14. As can be seen, for example, in FIG. 2, the joint 17 is subjected to an appropriate spring force by means of a spring 18. In addition, as a result of the spring force, the primary light source 4 tends to move/swivel out into its working position. If the handgun 3 is placed in its holster 14, the primary light source 4 is thereby pushed into the rest position against the spring force.

Of course, an almost identical design is also conceivable when the extension movement is realized in the form of a horizontal or vertical displacement of the primary light source 4 as previously discussed.

In an advantageous embodiment, it is provided that the at least one light source 2 has an energy supply 5 and that the light source 2 is only connected to the energy supply 5 in the working position. This prevents the light source 2 from transmitting light in its rest position. On the one hand, this enables an increased energy consumption to be avoided and, on the other, an officer who is carrying the handgun 3 does not unintentionally draw attention to himself due to a light source which is switched on unknowingly. As soon as the primary light source 4 is moved/swiveled out as previously described, the energy supply 5 is connected to the light source 2. An appropriate contact, for example, can be provided for this purpose. Conversely, the connection of the energy supply 5 to the light source 2, or the appropriate contact, is broken as soon as the primary light source 4 is retracted or swiveled in. The energy supply 5 mentioned is shown purely schematically in FIG. 2. It can be formed by any electrical energy store.

As can be clearly seen in FIG. 2, the light source 2 further includes a secondary light source 6. The secondary light source 6 is formed by at least one laser 61, in the variant shown in FIG. 2 by a plurality of lasers 61, 62, 63 of different wavelengths, wherein a first switching element 8 for selecting at least one laser 61, 62, 63 is provided on the battlefield illumination module 1.

Here, the different wavelengths of the individual lasers 61, 62, 63 must, of course, be chosen in such a way that there are differences in color which are clearly detectable to the human eye. For example, an appropriate red laser 61, green laser 62 and blue laser 63 can be used in the variant shown in FIG. 2. Also, the use of three lasers 61, 62, 63 is to be looked upon purely as an example. More or also fewer lasers 61, 62, 63, which differ with regard to their wavelength, can, of course, also be used.

As well as illuminating the immediate environment by means of the primary light source 4, this therefore also enables simplified sighting of possible targets by a mark on the target generated by the laser 61, 62, 63. As there is a choice of different lasers 61, 62, 63 with different wavelengths, several officers who are involved in a deployment can coordinate themselves with one another so that each officer can be assigned his "own" color-coded mark.

The first switching element 8 can be formed, for example, by using an appropriate DIP-switch or the like arranged on the battlefield illumination module 1.

In order to make it possible for any further officers who are taking part in a deployment to differentiate their appropriate mark generated by a laser 61, 62, 63 from those of other officers, it can be provided that a symbol-imaging ancillary lens 7 is positioned in front of at least one laser 61, 62, 63 of the secondary light source 6. Using at least one symbol-imaging ancillary lens of this kind enables the spot formed by the laser 61, 62, 63 on a target to be changed to an appropriate symbol. A circle, cross, crosshair, etc. can be chosen for the symbol. This enables them to be differentiated from one another on the target in spite of using lasers of the same wavelength, that is to say of the same color.

In order to be able to differentiate the largest possible number of officers or their target marks from one another, it can be provided that different symbol-imaging ancillary lenses 71, 72, 73 are positioned in front of the lasers 61, 62, 63 and the symbol-imaging ancillary lenses 71, 72, 73 are preferably replaceable.

This enables a multiplicity of options for combining different lasers with different ancillary lenses in order thus to be able to differentiate a multiplicity of target marks from one another.

If the light source 2 is not already activated when the primary light source 4 is extended, a second switching element 9 for the primary light source 4 and/or the secondary light source 6 can be provided on the battlefield illumination module 1. This enables the respective light source to be activated, or of course deactivated, accordingly as required. This second switching element 9 can be formed by a switch or button, for example, on the battlefield illumination module 1.

In addition, a third switching element 10, by means of which the primary light source 4 can be put into a non-light-emitting state as required, can be provided on the battlefield illumination module 1. For example, the immediate environment of the officer could already be adequately illuminated so that additional illumination by means of the primary light source 4 would only lead to an increased energy consumption but not to an improvement in the perceptibility of the immediate environment by the officer. Advantageously, it can be provided that the third switching element 10 is formed by a brightness sensor. As a result, the primary light source 4 can be switched to an inactive state without the officer having to manually operate the third switching element 10.

In a described battlefield illumination module 1, it can also be provided that the second switching element 9 is formed by a sensor arrangement 11. The use of an appropriate sensor arrangement 11 simplifies handling, as the second switching element 9 does not have to be operated accordingly by actuating a switch or button. Particularly in a stress situation, in which the officer no doubt finds himself during a deployment, this therefore increases the usability accordingly. Here, the "processing" of an appropriate sequence is not required, as the sensor arrangement 11 detects an appropriate hand or finger position, and the primary light source 4 and/or the secondary light source 6 is put into a light-emitting state.

Advantageously, the sensor arrangement 11 detects the immediate area of the trigger 13 of the handgun 3. As a result, the primary light source 4 and/or the secondary light source 6 is/are only activated or put into a light-emitting state when, for example, the finger of an officer is detected in the immediate area of the trigger 13 of the handgun 3. In this way, unintentional activation of the light source 2 or of the primary light source 4 and/or the secondary light source 6 is prevented. This also prevents a possible unintentional extended switching-on of the light source 2. The energy supply 5 of the light source 2 is accordingly conserved in this way.

In conjunction with the energy supply, the present invention provides a possibility of preventing premature failure of the light source 2 due to a lack of energy provision.

Figure 4:
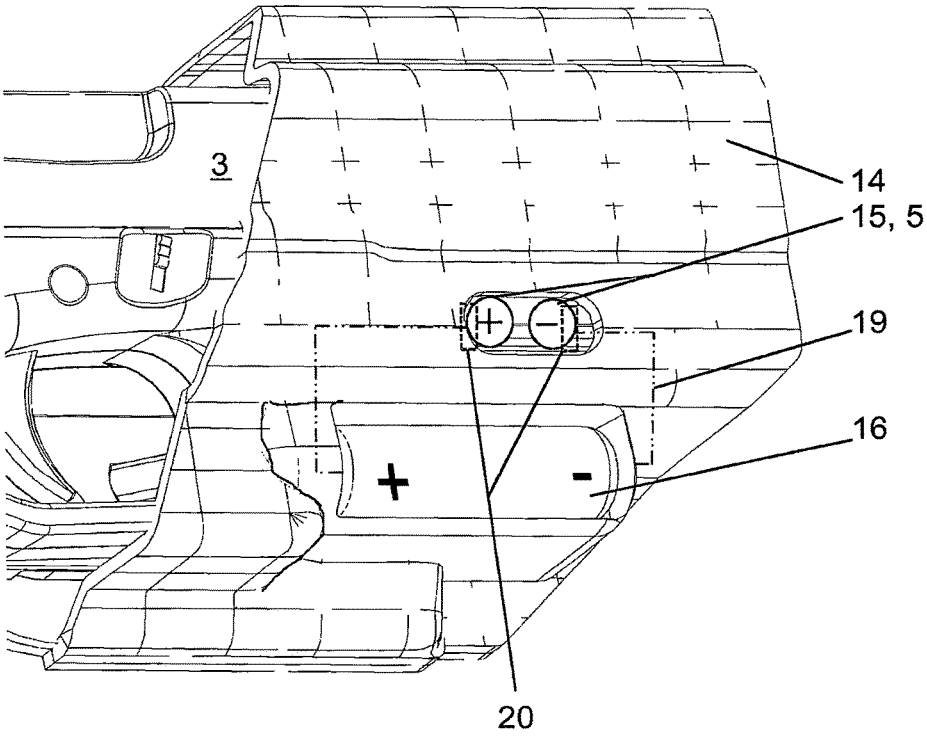
FIG. 4 shows parts of the handgun in a schematically shown holster.

As already previously stated, handguns 3 are usually kept in a holster 14. In this regard, FIG. 4 shows parts of the handgun 3 as inserted in the holster 14. Here, according to the invention, it is provided that the battlefield illumination module 1 has an electrical contact 15 to conduct a charging current. These contacts can also clearly be seen in FIG. 2 for example. Here, the electrical contact 15 is connected to the energy supply 5 of the light source 2, which is shown purely schematically in FIG. 2.

The holster 14 can have an electrical holster contact 20 for conducting a charging current which is connected by means of appropriate wires 19 to an energy source 16 which is external with respect to the battlefield illumination module 1, wherein, when the handgun 3 is located in the holster 14, the energy supply 5 of the light source 2 of the battlefield illumination module 1 attached to the handgun 3 is connected to the holster contact 20 by means of the electrical contact 15.

Here, only as an example, the energy source 16 is shown arranged within the holster 14. The energy source 16 can, of course, also be worn outside the holster, for example on the officer's belt. A direct contact of the electrical contact 15 with the holster contact 20 is not absolutely necessary. For example, the electrical contact 15 and the holster contact 20 can also be appropriate contacts which work in an inductive manner.

This enables the energy supply 5 of the light source 2 of the battlefield illumination module 1 attached to the handgun 3 to be recharged while the handgun 3 is stored within the holster 14. This prevents an unexpected failure of the light source 2 due to a lack of energy provision. At the same time, it must be considered that the energy source 16 must have an appropriate capacity and current strength to enable the energy supply 5 of the light source 2 to be charged.

As a consequence of the different embodiments described, the described battlefield illumination module 1 which can be used for a handgun 3 has a design which is as compact as possible.

The invention claimed is:

1. A battlefield illumination module for mechanically linking to a handgun, the battlefield illumination module comprising:

a fixing system for fixing the battlefield illumination module to the handgun, a light source, the light source having a front surface being designed for illuminating a battlefield, wherein the light source includes a primary light source which is designed to be moveable from a rest position such that, when the battlefield illumination module is fixed to the handgun, the front surface is substantially parallel to a longitudinal axis of a barrel of the handgun to a working position such that the front surface is offset from the longitudinal axis of the barrel where the primary light source illuminates an area ahead of the barrel.

2. The battlefield illumination module according to claim 1, wherein the light source has an energy supply and the light source is only connected to the energy supply in the working position.

3. The battlefield illumination module according to claim 1, wherein the light source further comprises a secondary light source and the secondary light source is formed by at least one laser.

4. The battlefield illumination module according to claim 3, wherein the secondary light source is formed by a plurality of lasers of different wavelengths and a first switching element for selecting at least one laser of said plurality of lasers is provided on the battlefield illumination module.

5. The battlefield illumination module according to claim 3, wherein a symbol-imaging ancillary lens is positioned in front of the at least one laser.

6. The battlefield illumination module according to claim 5, wherein various symbol-imaging ancillary lenses are positioned in front of the at least one laser.

7. The battlefield illumination module according to claim 4, wherein a second switching element for the primary light source and/or the secondary light source is provided on the battlefield illumination module.

8. The battlefield illumination module according to claim 7, wherein a third switching element, by means of which the primary light source can be put into a non-light-emitting state as required, is provided on the battlefield illumination module.

9. The battlefield illumination module according to claim 8, wherein the third switching element is formed by a brightness sensor.

10. The battlefield illumination module according to claim 7, wherein the second switching element is formed by a sensor arrangement.

11. A handgun having a trigger and the battlefield illumination module according to claim 1, wherein a sensor arrangement detects an immediate area of the trigger.

12. The battlefield illumination module according to claim 2, wherein the light source further comprises a secondary light source and the secondary light source is formed by at least one laser.

13. The battlefield illumination module according to claim 4, wherein a symbol-imaging ancillary lens is positioned in front of the at least one laser of said plurality of lasers.

14. The battlefield illumination module according to claim 6, wherein the various symbol-imaging ancillary lenses are replaceable.

15. The battlefield illumination module according to claim 1, wherein the primary light source is adapted to pivot from the rest position to the working position in relation to the battlefield illumination module.

16. A battlefield illumination module for mechanically linking to a handgun, the handgun having a barrel and a trigger, the battlefield illumination module comprising:

a fixing system for fixing the battlefield illumination module to the handgun, a light source having a front surface for illuminating a battlefield;

wherein the light source includes a primary light source that is extendable from a rest position such that, when the battlefield illumination module is fixed to the handgun, the front surface is substantially parallel to the barrel, in which no light is emitted, and moveable to a working position such that the front surface is offset from the barrel where the primary light source illuminates an area ahead of an end of the barrel.

17. The battlefield illumination module according to claim 16, wherein the primary light source is affixed in an area below the barrel of the handgun.

18. The battlefield illumination module according to claim 16, wherein the primary light source is mounted to a fixing facility below the barrel of the handgun.

19. The battlefield illumination module according to claim 16, wherein the light source has an energy supply and the light source is only connected to the energy supply in the working position.

20. The battlefield illumination module according to claim 16, further comprising:

a holster for accommodating the handgun;

wherein said holster has an electrical holster contact for charging an energy source of the battlefield illumination module.

21. The battlefield illumination module according to claim 16, wherein the primary light source is extendable from the rest position, substantially parallel to the barrel, to the working position, substantially perpendicular to the barrel.

22. A battlefield illumination module for mechanically linking to a handgun, the handgun having a barrel and a trigger, the battlefield illumination module comprising:

a fixing system for fixing the battlefield illumination module to the handgun, a light source having a front surface for illuminating a battlefield;

wherein the light source includes a primary light source that is rotatable about a joint from a rest position such that, when the battlefield illumination module is fixed to the handgun, the front surface is substantially parallel to the barrel, to a working position such that the front surface is substantially perpendicular to the barrel, the primary light source facing a same direction as an end of the barrel when in the working position.

* * * * *